US005320411A

United States Patent [19]

Sera

[11] Patent Number: 5,320,411

[45] Date of Patent: Jun. 14, 1994

[54] FLIP-UP SEAT CONSTRUCTION

[75] Inventor: Makoto Sera, Yokohama, Japan

[73] Assignee: Kotobuki Seating Co., Ltd., Tokyo, Japan

[21] Appl. No.: 796,733

[22] Filed: Nov. 25, 1991

[51] Int. Cl.[5] ..... A47C 1/121

[52] U.S. Cl. ..... 297/335; 297/331

[58] Field of Search ..... 297/335, 331, 332, 333, 297/336, 313, 443, 248, 440.15

[56] References Cited

U.S. PATENT DOCUMENTS

| | | | |
|---|---|---|---|
| 139,389 | 5/1873 | Holzer | 297/332 |
| 1,165,654 | 12/1915 | Eisner | 297/332 X |
| 1,328,181 | 1/1920 | Miller | 297/335 |
| 3,522,970 | 8/1970 | Francis | 297/335 |
| 3,658,382 | 4/1972 | Anderson | 297/443 X |
| 3,744,843 | 7/1973 | Barecki et al. | 297/332 X |
| 3,762,764 | 10/1973 | McJunkin | 297/331 X |
| 3,813,149 | 5/1974 | Lawrence, III et al. | 297/335 |
| 4,365,840 | 12/1982 | Kehl et al. | 297/443 |

*Primary Examiner*—Kenneth J. Dorner
*Assistant Examiner*—Milton Nelson, Jr.
*Attorney, Agent, or Firm*—Robbins, Berliner & Carson

[57] ABSTRACT

A flip-up seat construction includes a frame unit having a seat-back assembly, supporting a seat-back portion of a seat pan, and a bottom assembly, supporting a bottom portion of the seat pan and swingably attached to the seat-back assembly to move the bottom portion between a horizontal seat position and a stand-up position. The seat-back assembly includes, first and second horizontal members, horizontally extending at positions corresponding to the upper and lower ends of the seat-back portion of the seat pan, first and second side members, respectively connected to the ends of each of the first and second horizontal members, and a swingably supporting member, integrally constructed with the first and second side members of the seat-back assembly and swingably supporting the bottom assembly. The bottom assembly includes, first and second horizontal members, horizontally extending at positions corresponding to the back and front ends of the bottom portion of the seat pan, and first and second side members respectively connected to the both ends of each of the first and second horizontal members. The back ends of the bottom portion/first and second side members are swingably supported by the swingably supporting member of the seat-back assembly.

6 Claims, 4 Drawing Sheets

FLIP-UP SEAT CONSTRUCTION

BACKGROUND OF THE INVENTION

1. Field of the Invention

The present invention relates to a flip-up seat construction which has at least one seat pan having a fixed seat-back portion, and a bottom portion which is capable of moving between a horizontal seat position and a stand-up position.

U.S. patent application Ser. No. 729,947 filed by the same inventor of the present invention discloses a seat construction of which at least one seat pan has a bottom portion and a fixed seat-back portion. However, according to that seat construction, the bottom portion of the seat pan cannot be moved between the horizontal position and the stand-up position.

The flip-up seat construction has been widely used in mass transportation vehicles, such as buses and trains, and in public buildings, such as theaters, and concert halls where many people gather.

In the above-mentioned mass transportation vehicles and public buildings, flip-up seats are used to make more floor area available for passengers or for personnel accommodation, or to make cleaning the floor easier. Also, in recent years, flip-up seats have been used to make more floor area available for wheelchairs as required.

The conventional flip-up seat construction comprises a frame unit that includes a seat-back block which supports a seat-back portion of a seat pan, a bottom block which supports the bottom portion of the seat pan and which is swingably attached to the seat-back block so that the bottom portion of the seat pan can move between the horizontal seat position and the stand-up position. Each of the seat-back block and the bottom block is integrally formed by one member.

In this conventional construction, it is not easy to change the number of seats, the width of the seat construction, and therefore it is not easy to adjust a flip-up seat construction for a particular mass transportation vehicle or a public building.

In addition, any change in the construction requires substantial change to production line.

SUMMARY OF THE INVENTION

The present invention is directed to solving the above-mentioned problems. An object of the present invention is to provide a flip-up seat construction whereby it is easy to change the number of seats and to change the width of the seat construction so that the flip-up seat construction can be installed easily in a mass transportation vehicle or in a public building.

The above-mentioned object can be attained by constructing a frame unit of a flip-up seat construction as follows, to the frame unit of which at least one seat pan having a bottom portion and a seat-back portion is fixed to make the bottom portion of the seat pan be movable between a horizontal seat position and a stand-up position.

The frame unit includes a seat-back assembly which supports the seat-back portion of the seat pan, and a bottom assembly which supports the bottom portion of the seat pan and is swingably attached to the seat-back assembly to move the bottom portion of the seat pan between the horizontal seat position and the stand-up position.

The above seat-back assembly of the frame unit includes: a seat-back portion/first horizontal cross member which extends horizontally at a position corresponding to an upper end of the seat-back portion of the seat pan; a seat-back portion/second horizontal cross member which extends horizontally at a position corresponding to a lower end of the seat-back portion of the seat pan; a seat-back portion/first side member which is connected to the respective one ends of the first and second horizontal cross members; a seat-back portion/-second side member which is connected to the respective other ends of the first and second horizontal cross members; and a swingably supporting member which is integrally constructed with the first and second side members and swingably supports the bottom assembly of the frame unit.

The bottom assembly of the frame unit includes: a bottom portion/first horizontal cross member which extends horizontally at a position corresponding to a back end positioned near the lower end of the seat-back portion in the bottom portion of the seat pan; a bottom portion/second horizontal cross member which extends horizontally at a position corresponding to a front end positioned away from the lower end of the seat-back portion in the bottom portion of the seat pan; a bottom portion/first side member which is connected to the respective one ends of the first and second horizontal cross members; and a bottom portion/second side member connected to the respective other ends of the first and second horizontal cross members.

In the bottom portion/first and second side members, the positions corresponding to the back end of the bottom portion of the seat pan are swingably supported by the swingably supporting member of the seat-back assembly of the frame unit.

According to the above-structured flip-up seat construction of the present invention, only by changing the respective lengths of the plurality of horizontal cross members of the seat-back assembly and those of the plurality of horizontal cross members of the bottom assembly, it is possible to easily perform the change of the number of seats, the change of the width of the seat construction, and the change of the width of the seat construction corresponding to the change of the method for installing the flip-up seat construction to the mass transportation system or the public building. Moreover, these horizontal cross members can be manufactured at low cost by cutting a linear construction member, which is available in the market, to a predetermined length.

According to the above-structured flip-up seat construction of the present invention, fittings or supporting legs may be fixed to predetermined positions of the flip-up seat construction by a predetermined method, so that the flip-up seat construction can be attached to the floor or the wall of a mass transportation vehicle or a public building in a desired state in either a forward, sideward or oblique direction.

In the above-structured flip-up seat construction of the present invention, it is preferable that the seat-back assembly or the bottom assembly of the frame unit comprises swing prohibiting means for selectively prohibiting the swingable movement of the bottom assembly when the bottom portion of the seat pan is arranged at the stand-up position.

The swing prohibiting means surely prohibits the accidental swingable movement of the bottom portion of the seat pan from the stand-up position to the seat position and prevents a person or an object from being injured or damaged by the swing-down bottom portion. When a mass transportation vehicle moves, large swing moment can be produced in the flip-up construction. Therefore, the existence of the swing prohibiting means is particularly important in a case where the flip-up seat construction in the mass transportation system for passengers is shaken with the bottom portion of the seat pan being arranged at the stand-up position.

According to the above-structured flip-up seat construction of the present invention, it is preferable that the seat-back assembly of the frame unit further comprises a seat-back portion/additional horizontal cross member which horizontally extends at a position corresponding to the lower portion of the back end of the bottom portion of the seat pan, and first and second side connection members which are fixed to both ends of the additional horizontal cross member and fixed to the seat-back portion/first and second side members. The swingably supporting member is preferably mounted on the first and second side connection members, and the swing prohibiting means is preferably mounted on the additional horizontal cross member.

According to the above-mentioned structure for the swingably supporting member and the swing prohibiting means, those member and means can easily correspond to the change in the width of the flip-up seat construction only by changing the length of the seat-back portion/additional horizontal cross member. Moreover, since the swing prohibiting means is mounted on the seat-back portion/additional horizontal cross member, the swing prohibiting means can be prevented from being projected from the side surface of the flip-up seat construction. Therefore, the space, which is necessary for installing the flip-up seat construction, can be reduced. This is important for the mass transportation system for passengers whose load efficiency is emphasized.

According to the above-structured flip-up seat construction of the present invention, it is further preferably that the swing prohibiting means comprises an engaging lever, which is connected to the seat-back portion/additional horizontal cross member of the seat-back assembly of the frame unit to be vertically swingable and which extends to the front end of the bottom portion of the seat pan in the seat position, and the engaging lever is selectively engaged with the bottom portion/first horizontal cross member of the bottom assembly when the bottom portion of the seat pan is located at the stand-up position.

The above-structured swing prohibiting means is concealed by the bottom assembly, which supports the bottom portion, when the bottom portion of the seat pan is arranged at the seat position, and is exposed only when the bottom portion is arranged at the stand-up position.

According to the above-structured flip-up seat construction of the present invention, it is preferable that the end portion of the bottom assembly, which is located near the swing center of the bottom portion/first and second side members, contacts the lower end portions of the seat-back portion/first and second side members of the seat-back assembly when the bottom portion of the seat pan is arranged at the seat position, thereby prohibiting the swingable movement of the bottom assembly from the seat position.

According to the above structure, it is unnecessary to provide specially independently a stop mechanism for the bottom assembly when the bottom portion of the seat pan is arranged at the seat position.

According to the flip-up seat construction of the present invention, it is preferable that: each of the seat-back portion/first and second side members includes an inside portion connected to one end or the other end of each of the seat-back portion/first and second horizontal cross members, and an outside portion fixed to the outside of the inside portion to cover the inside portion; each of the bottom portion/first and second side members includes an inside portion connected to one end or the other end of each of the bottom portion/first and second horizontal cross members, and an outside portion fixed to the outside of the inside portion to cover the inside portion; and the bottom portion/second horizontal cross member includes an inside portion and an outside portion fixed to the outside of the inside portion to cover the inside portion.

The seat-back portion/first and second side members, each including the inside portion and the outside portion, improve rigidity of the seat-back assembly without largely increasing the weight of the seat-back assembly. Moreover, the bottom portion/first and second side members and the bottom portion/second cross member, each including the inside portion and the outside portion, improve rigidity of the bottom assembly without largely increasing the weight of the bottom assembly.

These outside portions of various members can be formed of a material different from the material of the inside portions, such as stainless steel, in order to improve the appearance of the flip-up seat construction.

According to the flip-up seat construction of the present invention, it is preferable that the seat-back portion/additional horizontal cross member includes an inside portion connected to the first and second side connecting members, and an outside portion fixed to the outside of the inside portion to cover the inside portion.

The above-structured seat-back portion/additional horizontal cross member improves rigidity of the bottom assembly without largely increasing the weight of the bottom assembly. Moreover, the outside portion can be formed of a material different from the material of the inside portion, such as stainless steel, in order to improve the appearance of the file-up seat construction.

If the flip-up seat construction, which can attain the above-mentioned objects of the invention, has at least two or more the above-structured seat pan, it is preferable that the seat-back assembly of the frame unit further comprises at least one seat-back portion/intermediate member which is fixed to the seat-back portion/first and second horizontal cross members between both ends of these members in the longitudinal directions thereof. Moreover, the bottom assembly further comprises at least one bottom portion/intermediate member which is fixed to the bottom portion/first and second horizontal cross members between both ends of the members in the longitudinal directions thereof.

According to the above-mentioned structure, if at least two seat pans are provided, the number of the seat-back portion/intermediate members of the seat-back assembly and that of the bottom portion/intermediate members of the bottom assembly can be suitably increased in accordance with the number of the seat pans, thereby rigidity of the flip-up seat construction can be prevented from being reduced.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

An embodiment of the flip-up seat construction of the present invention will be described with reference to the drawings.

CONSTRUCTION

Figure 1:
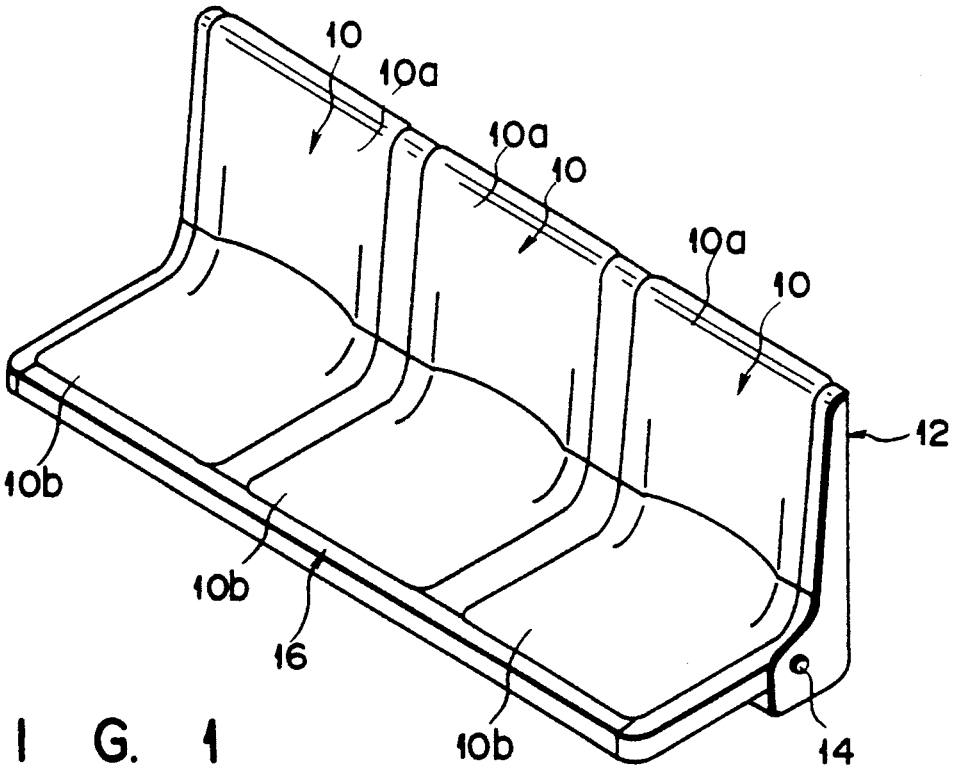
FIG. 1 is a perspective view schematically showing one embodiment of the flip-up seat construction of the present invention, bottom portions of seat pans of this construction being arranged at a horizontal seat position.

FIG. 1 schematically shows the appearance of one embodiment of the flip-up seat construction of the present invention in a state where bottom portions 10*b* of seat pans 10 are arranged at a horizontal seat position.

Figure 2:
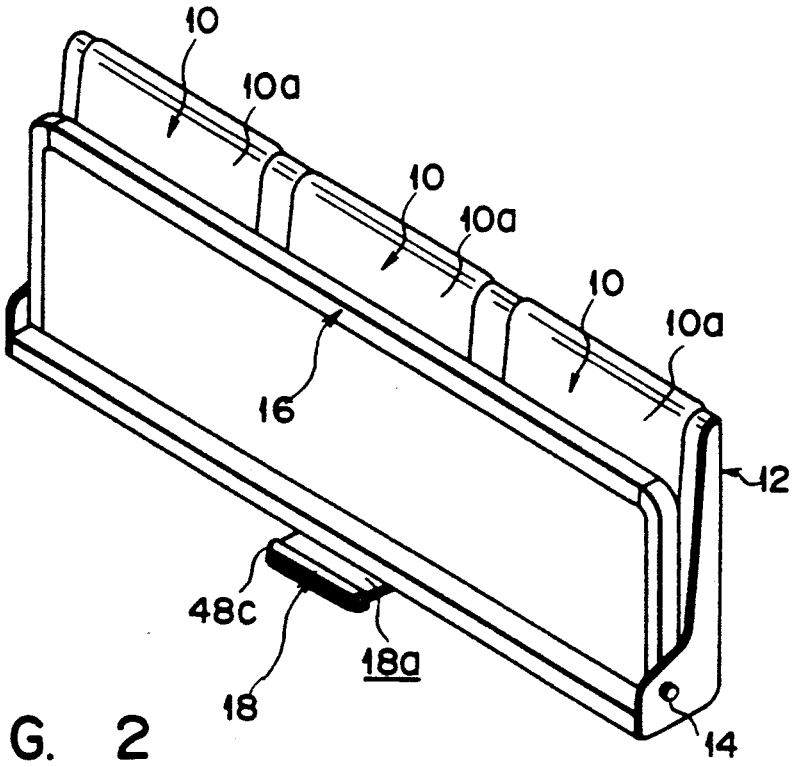
FIG. 2 is a perspective view schematically showing the flip-up seat construction of FIG. 1 in a state that the bottom portions of the seat pans are arranged at a stand-up position.

FIG. 2 schematically shows the appearance of the above described one embodiment of the flip-up seat construction of the present invention in a state where the bottom portions 10*b* of the seat pans 10 are arranged at a stand-up position.

The flip-up seat construction of this embodiment has three seat pans 10 arranged side by side. Each of the seat pans 10 comprises a seat-back portion 10*a*, whose central portion in its width direction is curved gently backward to fit the back of a human body, and a bottom portion 10*b*, whose central portion in its width direction is curved gently downward to fit buttocks of the human body in a sitting posture. The seat-back portion 10*a* and the bottom portion 10*b* are formed of metal or plastic and can be provided with cushions in their surfaces.

A frame unit supporting the three seat pans 10 comprises a seat-back assembly 12, which is substantially vertically arranged to support the seat-back portions 10*a* of the three seat pans 10, and a bottom assembly 16, which supports the seat portions 10*b* of the three seat pans 10 and whose back end portion is connected to the lower end portion of the seat-back assembly 12 by pivotal center shafts 14 to make the three seat portions 10*b* freely swingable between the horizontal seat position shown in FIG. 1 and the stand-up position shown in FIG. 2.

As shown in FIG. 2, a swing prohibiting means 18 is provided at a substantially central point of the lower end portion of the seat-back assembly 12 along its width to selectively hold the bottom assembly 16 in a state that it brings the bottom portions 10*b* of the seat pans 10 to the stand-up position. An operation handle 18*a* of the swing prohibiting means 18 can be visually recognized when the bottom assembly 16 and the bottom portions 10*b* of the seat pans 10 are at the stand-up position as shown in FIG. 2. However, when the bottom assembly 16 and the seat portions 10*b* of the seat pans 10 are horizontal, as shown in FIG. 1, the operation handle 18*a* of the swing prohibiting means 18 and the entire swing prohibiting means 18 are covered by the bottom assembly 16.

As shown in FIG. 1, when the bottom portions 10*b* of the seat pans 10 are horizontal, the back end of the upper surface of each bottom portion 10*b* couples smoothly with the front surface of the lower end of the corresponding seat-back portion 10*a* of the seat pans 10.

Figure 3:
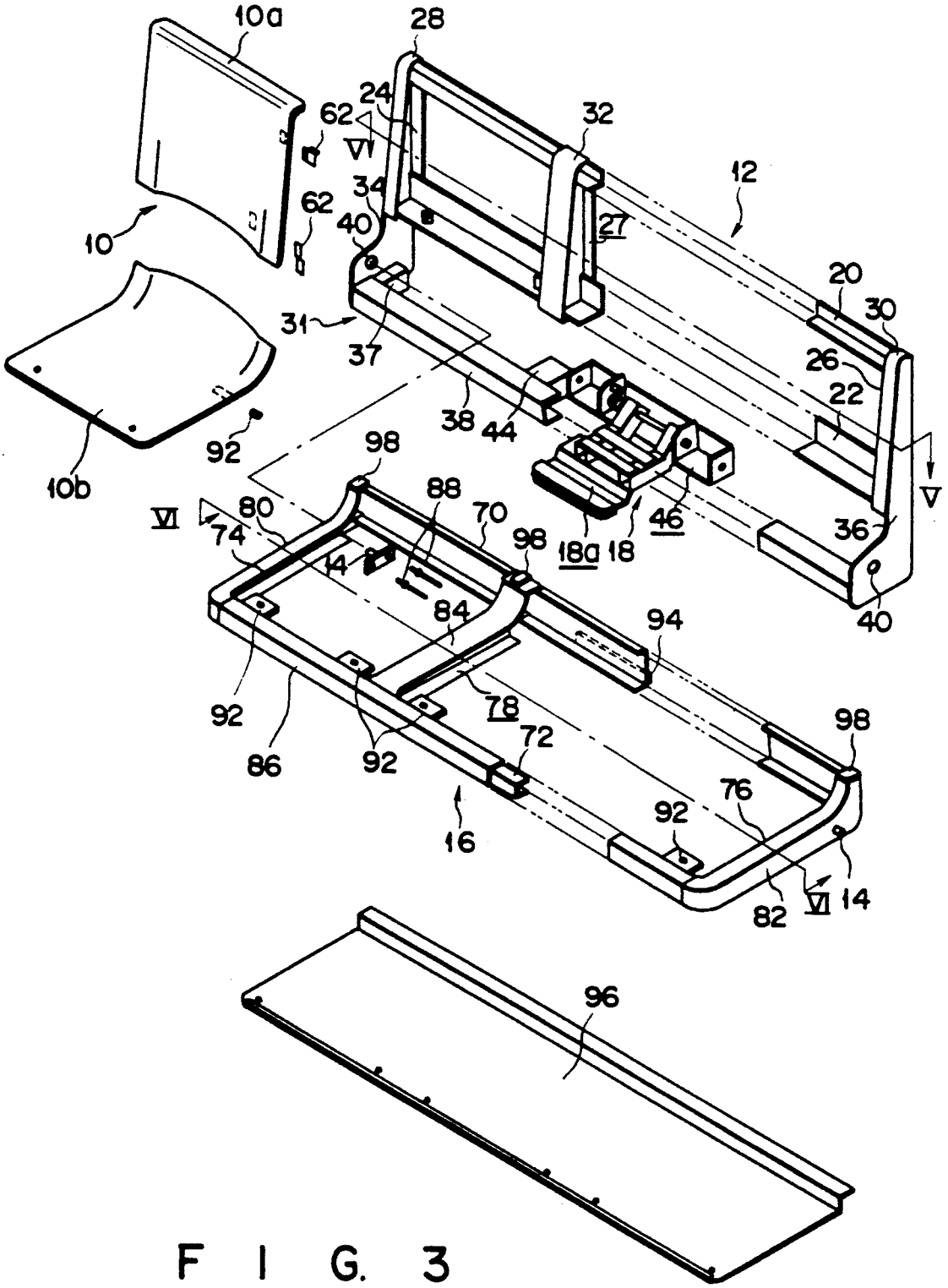
FIG. 3 is a schematical exploded perspective view of the flip-up seat construction of FIG. 1.

FIG. 3 schematically shows an exploded perspective view of the flip-up seat construction of the embodiment schematically shown in FIGS. 1 and 2.

As shown in FIG. 3, the seat-back assembly 12 comprises a seat-back portion/first horizontal cross member 20 horizontally extending at a position corresponding to the upper ends of the seat-back portions 10*a* of the seat pans 10, and a seat-back portion/second horizontal cross member 22 horizontally extending at a position corresponding to the lower ends of the seat-back portions 10*a* of the seat pans 10. A seat-back portion/first inside side-member 24, which extends in a vertical direction, is connected to one end of each of the first and second horizontal cross members 20 and 22 by well-known connecting means such as welding. A seat-back portion/second inside side-member 26, which extends in the vertical direction, is connected to the other end of each of the first and second horizontal cross members 20 and 22 by well-known connecting means such as welding.

Figure 5:
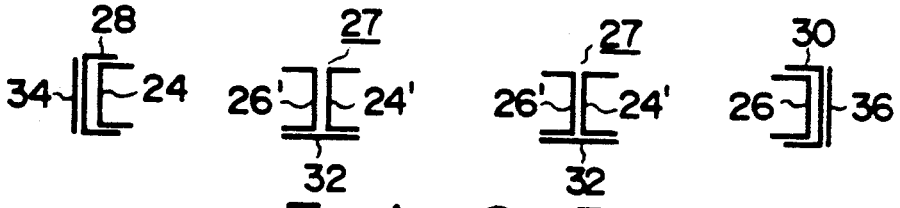
FIG. 5 is a cross sectional view schematically showing a cross-section along a line V—V in FIG. 3.

In this embodiment, each of the first and second horizontal cross members 20 and 22 is formed of a steel strip with a substantially L-shaped cross section. Each of the first and second inside side-members 24 and 26 is formed of a steel strip having a substantially angular U-shaped groove in its cross section, and the side-members 24 and 26 are arranged as shown in FIG. 5 to make their grooves opposite each other.

Two seat-back portion/inside intermediate members 27, which extend in the vertical direction, are connected by well-known means such as welding, to the first and second horizontal cross members 20 and 22 at two respective parts between both ends of the first and second horizontal cross members 20 and 22 in their longitudinal directions corresponding to the boundaries of the seat-back portions 10*a* of the three seat pans 10 (FIG. 3 shows only one inside intermediate member 27). The inside intermediate member 27, as shown in FIG. 5, is constructed of two steel strips 24', 26', having respectively the same shape and size as those of the respective first and second inside side-members 24, 26, with their back surfaces being connected to each other.

Seat-back portion/first and second outside side-members 28 and 30 are connected by well-known means, such as welding, to the outside surfaces of the seat-back portion/first and second inside side-members 24 and 26 to cover the outer surfaces of these inside side-members 24 and 26. In this embodiment, the seat-back portion/-first and second outside side-members 28 and 30 are formed of stainless steel in order to improve the appearance of the flip-up seat construction.

Seat-back portion/outside intermediate member 32 is connected by well-known means such as welding to the outer surface of each of the inside intermediate member 32, and the outside intermediate member 32 is formed of a band-shaped stainless steel strip with its upper end portion being curved backward.

Moreover, a swingably supporting member 31, which extends downward beyond the lower ends of the seat-back portion/first and second outside side-members 28 and 30, is fixed to the outside surfaces of the first and second outside side-members 28 and 30. In this embodiment, the swingably supporting member 31 is connected by well-known connecting means such as welding to the outside surfaces of the first and second outside side-members 28 and 30. The swingably supporting member 31 comprises first and second side connection members 34 and 36, which extend downward beyond the lower ends of the first and second outside side-members 28 and 30 and whose lower end portions project forward. Support member 31 also comprises a seat-back portion/inside additional horizontal cross member 37, which extends horizontally. Both ends are connected to respective forward projecting portions of the lower ends of the first and second side connection members 34 and 36 by well-known connecting means such as welding. Support member 31 also comprises a seat-back portion/outside additional horizontal cross member 38, which is fixed to the inside additional horizontal cross member 37 and covers the outer surface of the inside additional horizontal cross member 37.

The first and second side connection members 34 and 36 and the outside additional horizontal cross member 38 are respectively formed of stainless steel. The outside additional horizontal cross member 38 has a substantially angular U-shaped groove in its cross section. The opening of the groove is directed backward.

Respective junctions between the first and second side connection members 34, 36 and the first and second outside side-members 28, 30 are made in such a way as to produce a continuous and smooth outer surface, thereby improving the appearance of the flip-up seat construction.

Coaxial shaft holes 40 are formed in the forward projecting portions of the lower ends of the first and second side connection members 34 and 36 at positions above the both ends of the outside additional horizontal cross member 38.

The swing prohibiting means 18 shown in FIG. 2 is fixed to the substantially center portion of the inside additional horizontal cross member 37 in the longitudinal direction. The swing prohibiting means 18 comprises a base 46, which is connected by a pair of support arms 44 (FIG. 3 shows only one support arm) in the backward position of the center of the inside additional horizontal cross member 37. The operation handle **18*a* extends forward from the base 46 and passes below the inside and outside additional horizontal cross members 37 and 38** and extends forward from them.

Figure 4:
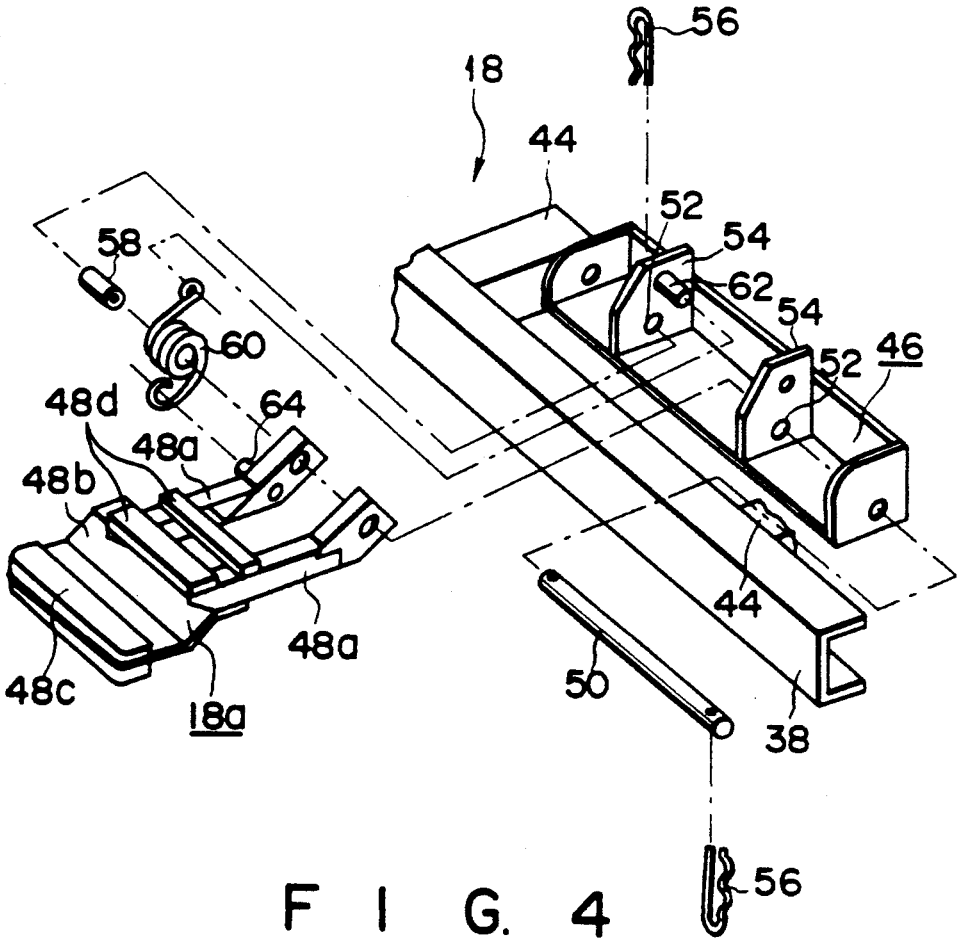
FIG. 4 is a schematical exploded perspective view showing a swing prohibiting means of the flip-up seat construction of FIG. 1 in an expanded scale.

FIG. 4 is an exploded and enlarged view showing the swing prohibiting means 18. The base 46 of the swing prohibiting means 18 includes a pair of supporting walls 54 having coaxial through holes 52 through which is inserted a rotational center shaft 50 horizontally extending parallel with the inside and outside additional horizontal cross members 37 and 38. Stop pins 56 are fitted on both ends of the rotational center shaft 50 to prevent the rotational center shaft 50 from slipping out from the through holes 52.

The operation handle **18*a* of the swing prohibiting means 18 has a pair of engaging arms 48*a* whose back ends are rotatably supported by the rotational center shaft 50 of the base 46. The pair of the engaging arms 48*a* pass under the inside and outside additional horizontal cross members 37 and 38 and extend forward therefrom. The lower surfaces of the front end portions of the engaging arms 48*a* are connected to each other by a grip support member 48*b*. A grip 48*c* is attached to the grip support member 48*b*. The grip 48*c* is formed of a material having a good appearance, such as acrylic resin, in order to improve the appearance of the flip-up seat construction because the grip 48*c* can be visually recognized when the seat portion 10*b* of the seat pan 10 is in the stand-up position as shown in FIG. 2**.

A pair of engaging pieces **48*d* are fixed on the upper surfaces of the front end portions of the pair of engaging arms 48*a* at a position located backward from the inside and outside additional horizontal cross members 37 and 38, so that the engaging pieces 48*d*** are arranged to be parallel to each other with a small gap therebetween.

A torsion coil spring 60 is wound around a bush 58 fitted on the rotational center shaft 50 of the base 46 of the swing prohibiting means 18. The bush 58 is formed of a low frictional material such as nylon. One end of the torsion coil spring 60 is hooked on a spring hooking pin 62 fixed to one of supporting walls 54 of the base 46. The other end of the spring 60 is hooked on a spring hooking pin 64 fixed to one of the engaging arms **48*a* of the operation handle 18*a***.

Spring force of the torsion coil spring 60 urges engaging arms **48*a* upward. The upward rotation of engaging arms 48*a* generated by the spring force is restricted when the engaging arms 48*a* contacts the inside and outside additional horizontal cross members 37 and 38**.

The seat-back portions **10*a* of the three seat pans 10 are detachably attached through a plurality of brackets 62 to the seat-back portion/first and second horizontal cross members 20 and 22 between the seat-back portion/first and second outside side-members 28 and 30 and between the two seat-back portion/outside intermediate members 32**.

As shown in FIG. 3, the bottom assembly 16 comprises a bottom portion/first inside horizontal cross member 70, which horizontally extends at a position corresponding to the back end of the bottom portion **10*b* of the seat pan 10, and a bottom portion/second inside horizontal cross member 72, which horizontally extends at a position corresponding to the front end of the bottom portion 10*b* of the seat pan 10. A bottom portion/first inside side-member 74, which extends in a back and forth direction, is connected by well-known connecting means such as welding, between respective ends of the first and second inside horizontal cross members 70 and 72. A bottom portion/second inside side-member 76, which extends in the back and forth direction, is connected by well-known connecting means such as welding, to the respective other ends of the first and second inside horizontal cross members 70 and 72**.

In this embodiment, each of the first and second inside horizontal cross members 70 and 72 is formed of a steel strip having a substantially angular U-shaped groove in its cross section. The cross members 70 and 72 are arranged to make their grooves oppose to each other. The first and second inside side-members 74 and 76 are also formed of steel strips, respectively.

A bottom portion/inside intermediate member 78, which extends in the back and forth direction, is connected by well-known means such as welding, across the first and second inside horizontal cross members 70 and 72 at each of two positions corresponding to the boundaries of the bottom portions **10*b* of the three seat pans 10 between both ends of the first and second inside horizontal cross members 70 and 72 in their longitudinal direction. (FIG. 3 shows only one inside intermediate member 78**).

Bottom portion/first and second outside side-members 80 and 82 are connected by well-known means such as welding to the outside surfaces of the bottom portion/first and second inside side-members 74 and 76 to cover the outer surfaces of the inside side-members 74 and 76. In this embodiment, the first and second outside side-members 80 and 82 are formed of stainless steel to improve the appearance of the flip-up seat construction, and their back ends are curved upward.

A bottom portion/outside intermediate member 84 is connected by well-known means such as welding on the upper surface of the inside intermediate member 78. The outside intermediate member 84 is also formed of stainless steel, and has a band shape with its back end being curved upward.

The second inside horizontal member 72 is also covered with a bottom portion/outside horizontal cross member 86, which is also formed of stainless steel.

Junctions between the bottom portion/first and second outside side-members 80 and 82, the bottom portion/outside horizontal cross member 86, and the bottom portion/outside intermediate members 84 are made in such a manner as to produce the continuous and smooth outer surfaces, thereby improving the appearance of the flip-up seat construction.

Figure 6:
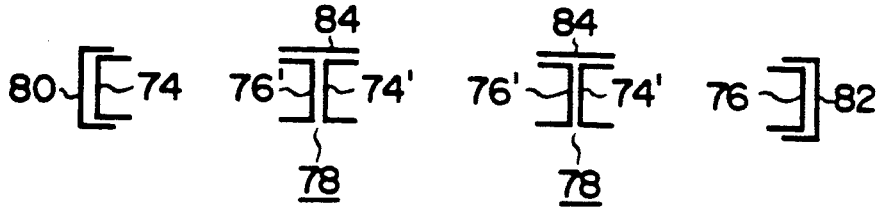
FIG. 6 is a cross sectional view schematically showing a cross-section along a line VI—VI in FIG. 3.

FIG. 6 shows the cross sections of the bottom portion/first inside and outside side-members 74, 80, the bottom portion/second inside and outside side-members 76, 82, and the bottom portion/inside and outside intermediate members 78, 84. As shown in FIG. 6, the inside intermediate member 78 is constructed by two steel members 74', 76', which have respectively the same shape and size as those of the first and second inside side-members 74, 76, and the steel members 74', 76' are connected at their back surfaces to each other.

The coaxial shafts 14 pass through the back ends of the bottom portion/first and second inside side-members 74 and 76 and also the back ends of the first and second outside side-members 80 and 82. The shafts 14 are fixed to the inner surfaces of the first and second inside side-members 74 and 76. The shafts 14 are rotatably inserted into the shaft holes 40 of the lower ends of the first and second side connection members 34 and 36 of the seat-back assembly 12.

The bottom portions **10*b* of the three seat pans 10 are detachably attached through a plurality of brackets 92 to the two bottom portion/inside intermediate members 78 and the bottom portion/second inside horizontal cross member 72 between the bottom portion/first and second outside side-members 80, 82 and the two bottom portion/outside intermediate members 84**.

An engaging hook 94, which extends in the longitudinal direction of the bottom portion/first inside horizontal cross member 70, is fixed to the back surface of the first inside horizontal cross member 70 at a position substantially central thereof in the longitudinal direction. The lower opening of the bottom assembly 16 is covered with a detachable lower cover 96.

Shock absorbing members 98 are fixed to the upper surfaces of the rear ends of the bottom portion/first and second outside side-members 80, 82 and the two bottom portion/outside intermediate members 84. When the seat assembly 16 and the bottom portions **10*b* of the three seat pans 10 are at the horizontal position as shown in FIG. 1, the shock absorbing members 98 abut against the lower ends of the seat-back portion/first and second inside side-members 24, 26, those of the seat-back portion/first and second outside side-members 28, 30, and those of the seat-back portion/inside and outside intermediate members 26, 32. The shock absorbing members 98** absorb shock generated by the abutment.

The flip-up seat construction, according to one embodiment of the present invention has the above assembled seat-back assembly 12 and bottom assembly 16, can be fixed to the predetermined position on the floor of mass transportation vehicles, such as buses or trains, or public building, such as a theater or a concert hall, by fixing a support leg or legs (not shown) to the back surface of the seat-back assembly 12.

Moreover, the back surface of the seat-back assembly 12, or the side surface thereof, can be directly fixed to the wall of the mass transportation system for passengers or that of the public building.

OPERATION

The bottom assembly 16 is maintained at the horizontal position for arranging the bottom portions **10*b* of the three seat pans 10 at the horizontal seat position shown in FIG. 1 by its weight around the pair of shafts 14**.

Figure 7:
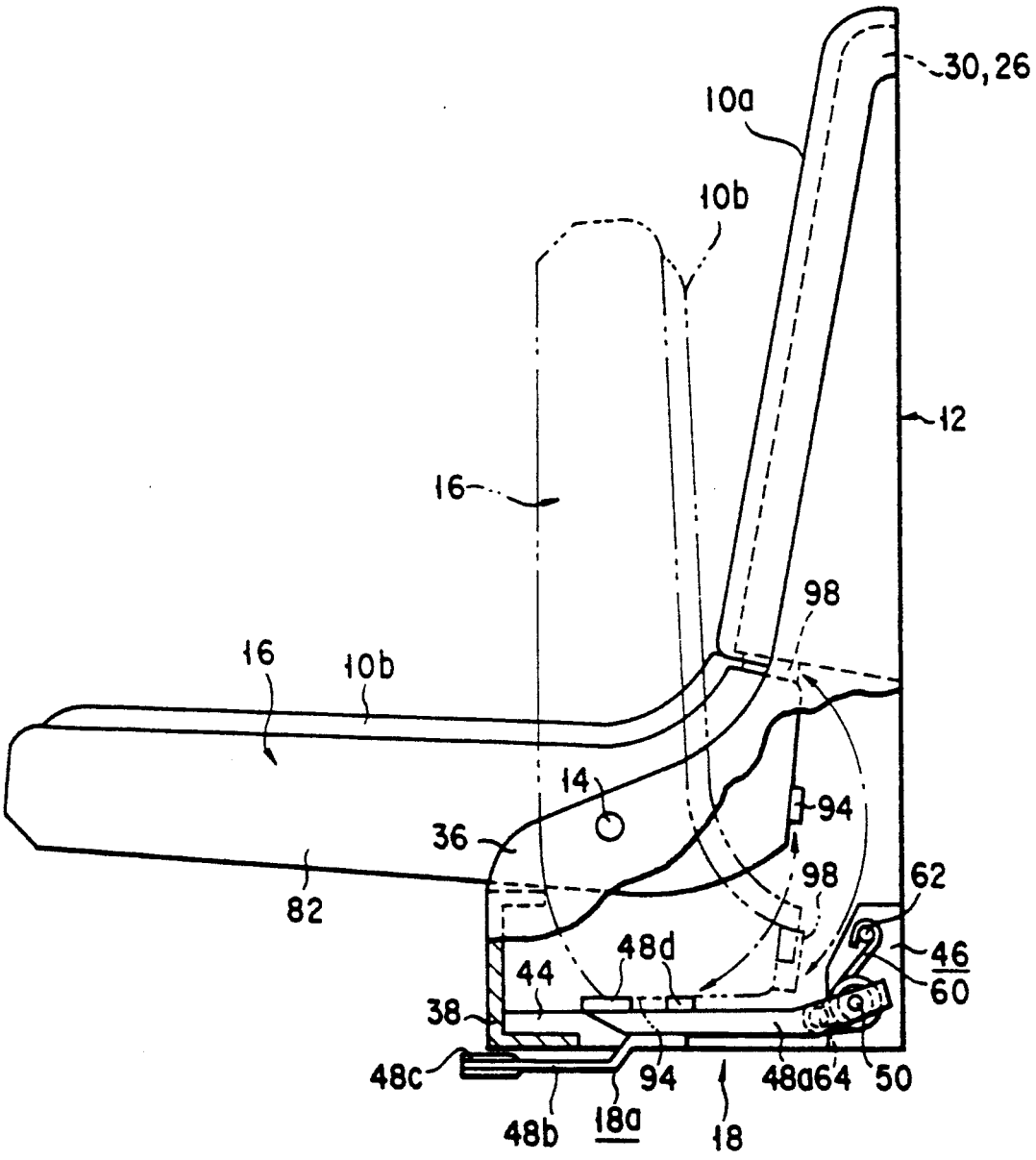
FIG. 7 is a side view of the flip-seat showing the function of the engaging hook.

In order to move the bottom portions **10*b* of the three seat pans 10 to the stand-up position shown in FIG. 2, upward force is applied to the front end of the bottom assembly 16, so that the bottom assembly 16 rotates upward around the paired shafts 14 located at both sides thereof. As can be seen in FIG. 7 the rotation of the bottom assembly 16 is slowed when the engaging hook 94 contacts the backward engaging piece of the paired engaging pieces 48*d* on the operation lever 18*a* of the swing prohibiting means 18. However, the rotation of the bottom assembly 16 continues, and the backward engaging piece 48*d* continues to be pressed downward by the engaging hook 94 against the spring force of the torsion coil spring 60 (FIG. 4). When the engaging hook 94 of the bottom assembly 16 comes into engagement with the gap between the paired engaging pieces 48*d* of the swing prohibiting means 18 of the seat-back assembly 12, the rotation of the bottom assembly 16 is stopped. At this time, the bottom portions 10*b* of the three seat pans 10 on the bottom assembly 16 are at the stand-up position as shown in FIG. 2**.

In order to move the bottom portions **10*b* of the three seat pans 10 to the horizontal seat position shown in FIG. 1 from the stand-up position shown in FIG. 2, the operation lever 18*a* of the swing prohibiting means 18, which is exposed at the central portion of the lower end of the seat-back assembly 12, is pressed downward against the spring force of the torsion coil spring 60 (FIG. 4). Thereby, the engaging hook 94 of the bottom assembly 16 is released from the paired engaging pieces 48*d* of the swing prohibiting means 18 of the seat-back assembly 16. In this state, the front end of the bottom assembly 16 is rotated downward. The bottom assembly 16 can arrange the bottom portions 10***b* of the seat pans 10 at the horizontal seat position shown in FIG. 1 by the abutment of the plurality of shock absorbing members 98 on the upper surface of the back end of the bottom assembly 16 to the lower end of the seat-back assembly 12.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A flip-up seat construction comprising:

at least one seat pan having a bottom portion, a seat-back portion separate from the bottom portion, and a frame unit which includes a seat-back assembly for supporting the seat-back portion and a bottom assembly for supporting the bottom portion, said bottom assembly being swingably attached to the seat-back assembly and swingable between a horizontal seat position and a stand-up position;

said seat-back assembly of said frame unit having:

a seat-back portion/first horizontal cross member which extends horizontally at a position corresponding to an upper end of said seat-back portion of said seat pan;

a seat-back portion/second horizontal cross member which extends horizontally at a position corresponding to a lower end of said seat-back portion of said seat pan;

a seat-back portion/first side member which is connected between respective ends at a first side of said seat-back portion/first and second horizontal cross members;

a seat-back portion/second side member which is connected between respective ends at a second side of said seat-back portion/first and second horizontal cross members; and a swingably supporting member which is integrally constructed with said seat-back portion/first and second side members and swingably supports said bottom assembly of said frame unit, and said bottom assembly of said frame unit having:

a bottom portion/first horizontal cross member which extends horizontally at a position corresponding to a back end of said bottom portion near the lower end of said seat-back portion when said bottom portion is in a horizontal seat position;

a bottom portion/second horizontal cross member which extends horizontally at a position corresponding to a front end of said bottom portion away from the lower end of said seat-back portion when said bottom portion is in a horizontal seat position;

a bottom portion/first side member which is connected between respective ends at a first side of said bottom portion/first and second horizontal cross members; and a bottom portion/second side member which is connected between respective ends at a second side of said bottom portion/first and second horizontal cross members;

wherein said bottom assembly has a center of swing located in the swingably supporting member below and in front of the lower end of said seat-back portion, wherein said seat-back assembly further comprises a seat-back portion/additional horizontal cross member which horizontally extends at a position lower than and in front of the center of swing of said bottom assembly, wherein said swingably supporting member having first and second side connection members which are fixed to said seat-back portion/first and second side members and which extend downward to both ends of said additional horizontal cross member, wherein said swingably supporting member of said seat-back assembly is mounted on said first and second side connection members, wherein a rear end portion of said bottom assembly located near the center of swing contacts lower ends of said seat-back portion/first and second side members of said seat-back assembly when said bottom portion of said seat pan is at the horizontal seat position and thereby prohibits the swing movement of said bottom assembly from the seat position in a direction opposite to the stand-up position, and a swing prohibiting means mounted on said additional horizontal member for prohibiting swing movement of said bottom assembly when said bottom assembly is in the stand-up position.

2. The flip-up seat construction according to claim 1, wherein each of said seat-back portion/first and second side members includes a seat-back/side inside portion connected to one of both ends of each of said seat-back portion/first and second horizontal cross members, and an outside portion fixed to an outside of said seat-back/-side inside portion to cover said seat-back/side inside portion, each of said bottom portion/first and second side members includes a bottom/side inside portion connected to one of both ends of each of said bottom portion/first and second horizontal cross members, and an outside portion fixed to an outside of said bottom/side inside portion to cover said bottom/side inside portion, and said bottom portion/second horizontal cross member includes a bottom/horizontal inside portion and an outside portion fixed to an outside of said bottom/-horizontal inside portion to cover said bottom/-horizontal inside portion.

3. The flip-up seat construction according to claim 1, wherein said seat-back portion/additional horizontal cross member includes a seat-back/horizontal inside portion connected to said seat-back portion/first and second side connection members, and an outside portion fixed to an outside of said seat-back/horizontal inside portion to cover said seat-back horizontal inside portion.

4. The flip-up seat construction according to claim 1, wherein said swing prohibiting means comprises an engaging lever rotatably supported by a shaft which is connected to said seat-back portion/additional horizontal cross member, said engaging lever being vertically swingable and extending to the front end of said bottom portion of said seat pan when said bottom portion is at the horizontal seat position, and said engaging lever selectively engages with said bottom portion/first horizontal cross member of said bottom assembly when said bottom portion of said seat pan is at the stand-up position.

5. A flip-up seat construction according to claim 1, wherein at least two seat pans are used, and wherein said seat-back assembly further includes at least one seat-back portion/intermediate member and wherein said bottom assembly further includes at least one bottom portion/intermediate member.

6. The flip-up seat construction according to claim 5, wherein said seat-back portion/intermediate member includes an inside portion having one end connected to a point on said seat-back portion/first horizontal cross member and another end connected to a point on said seat-back portion/second horizontal cross member, and an outside portion fixed to an outside of said inside portion to cover said inside portion, and said bottom portion/intermediate member includes an inside portion having one end connected to a point on said bottom portion/first horizontal cross member and another end connected to a point on said bottom portion/second horizontal cross member and an outside portion fixed to a surface of said inside portion at an upper side of said inside portion so as to cover said inside portion when said bottom assembly is at the horizontal seat position.

* * * * *